US007237784B1

(12) United States Patent
Monteleone

(10) Patent No.: US 7,237,784 B1
(45) Date of Patent: Jul. 3, 2007

(54) ROTATING SKATEBOARD

(76) Inventor: Joseph Monteleone, 319 Black Oak Ct., Seffner, FL (US) 33584

( * ) Notice: Subject to any disclaimer, the term of this patent is extended or adjusted under 35 U.S.C. 154(b) by 245 days.

(21) Appl. No.: 11/001,269

(22) Filed: Dec. 1, 2004

(51) Int. Cl.
*A63C 17/02* (2006.01)

(52) U.S. Cl. ..... 280/87.042; 280/87.03

(58) Field of Classification Search ..... 280/87.042, 280/87.041, 87.03, 87.021
See application file for complete search history.

(56) References Cited

U.S. PATENT DOCUMENTS

| | | | | | |
|---|---|---|---|---|---|
| 3,069,182 | A | | 12/1962 | Hufford | |
| 3,522,953 | A | * | 8/1970 | Gold et al. | 280/21.1 |
| 3,771,811 | A | * | 11/1973 | Bueno | 280/87.042 |
| 4,160,554 | A | * | 7/1979 | Cooney | 280/87.042 |
| 4,202,559 | A | | 5/1980 | Piazza, Jr. | |
| 4,230,330 | A | | 10/1980 | Muhammad | |
| 4,445,699 | A | | 5/1984 | Darasko | |
| 4,787,630 | A | * | 11/1988 | Watson et al. | 482/146 |
| 4,955,626 | A | | 9/1990 | Smith et al. | |
| 4,966,364 | A | * | 10/1990 | Eggenberger | 482/146 |
| 5,062,630 | A | * | 11/1991 | Nelson | 482/34 |
| 5,236,208 | A | | 8/1993 | Welsh | |
| 5,458,351 | A | * | 10/1995 | Yu | 280/87.042 |
| D430,635 | S | * | 9/2000 | Danache | D21/765 |
| 6,158,752 | A | * | 12/2000 | Kay | 280/87.042 |
| 6,257,614 | B1 | | 7/2001 | Duggan | |
| 6,419,248 | B1 | * | 7/2002 | Kay | 280/87.042 |
| 6,758,483 | B1 | * | 7/2004 | Sypniewski | 280/87.041 |
| 6,857,641 | B2 | * | 2/2005 | Bobrowicz | 280/14.21 |
| 6,942,487 | B2 | * | 9/2005 | Corbalis | 434/247 |
| 2005/0269794 | A1 | * | 12/2005 | Lukes | 280/87.042 |

* cited by examiner

*Primary Examiner*—Jeff Restifo
(74) *Attorney, Agent, or Firm*—Michael I. Kroll

(57) ABSTRACT

Apparatus 10 for a skateboard deck 14 connected to a skateboard carriage 22 by means of a rotative mechanism 24 positioned between the deck and carriage. The carriage 22 is comprised of a platform having the trucks and wheels 18 mounted thereunder with fasteners fixedly positioning a bearing insert 34 and carriage retaining ring 32 to the top side of the platform. The deck 14 has a friction ring 30 fixed to the underside with fasteners 28 passing through the deck and friction ring into the carriage retaining ring thereby enabling the deck to rotate relative to the carriage 22. Additionally fastened to the underside of the deck 14 are pivot brakes or segments 16 positioned on opposing ends of the deck 14 and within the perimeter of the carriage platform. Once the carriage platform 22 and deck 14 are relatively aligned, a user 12 shifts their weight causing the segments 16 to engage the carriage ending or preventing any further rotation of the deck relative to the carriage.

17 Claims, 11 Drawing Sheets

ROTATING SKATEBOARD

BACKGROUND OF THE INVENTION

1. Field of the Invention

The present invention relates generally to wheeled articles and, more specifically, to a skateboard deck connected to a carriage by means of a rotative mechanism positioned between the deck and carriage. The carriage is comprised of a platform having the trucks and wheels mounted thereunder with fasteners fixedly positioning a bearing and retaining ring to the top side of the platform.

The deck has a friction ring fixed to the underside with fasteners passing through the deck and friction ring into the carriage retaining ring thereby enabling the deck to rotate relative to the carriage. Additionally fastened to the underside of the deck are segments positioned on opposing ends of the deck and within the perimeter of the carriage platform. Once the carriage platform and deck are relatively aligned, a user shifts their weight causing the segments to engage the carriage ending or preventing any further rotation of the deck relative to the carriage.

2. Description of the Prior Art

There are other mechanisms designed for rotation. Typical of these is U.S. Pat. No. 3,069,182 issued to Hufford on Dec. 18, 1962.

Another patent was issued to Bueno on Nov. 13, 1973 as U.S. Pat. No. 3,771,811. Yet another U.S. Pat. No. 4,160,554 was issued to Cooney on Jul. 10, 1979 and still yet another was issued on May 13, 1980 to Piazza, Jr. as U.S. Pat. No. 4,202,559.

Another patent was issued to Muhammad on Oct. 28, 1980 as U.S. Pat. No. 4,230,330. Yet another U.S. Pat. No. 4,445,699 was issued to Darasko on May 1, 1984. Another was issued to Smith, et al. on Sep. 11, 1990 as U.S. Pat. No. 4,955,626 and still yet another was issued on Aug. 17, 1993 to Welsh as U.S. Pat. No. 5,236,208.

Another patent was issued to Yu on Oct. 17, 1995 as U.S. Pat. No. 5,458,351. Yet another U.S. Pat. No. 6,257,614 was issued to Duggan on Jul. 10, 2001. Another was issued to Fontaine on Sep. 11, 1996 as French Patent No. FR2760382 and still yet another was issued on Apr. 8, 1999 to Bourdeau as U.S. Pat. No. DE19845457.

U.S. Pat. No. 3,069,182

Inventor: Dennis F. Hufford

Issued: Dec. 18, 1962

A coaster wagon comprising a body having a front end, a rear end and sides, a rear axle connected to the body adjacent the rear end thereof and a pair of wheels supported by the rear axle, the body having a rearward horizontal portion extending from the rear end to a point forward of the center of the bed, the rearward horizontal portion being at substantially the level of the rear axle, the body having a forward horizontal portion at a level above the rearward horizontal portion, a sloping panel joined to the forward and rearward horizontal portions, a hole through the forward horizontal portion, a rod extending through the hole and having a head on its upper end for preventing downward movement of the rod through the hole, a disk supported by the lower end of the rod, the disk having a diameter only a little less than the length of the forward horizontal portion and having its upper surface bearing against the lower surface of the forward horizontal portion, a front axle supported beneath the disk, a pair of wheels supported by the front axle, a pair of vertical rods rigidly connected to the front axle adjacent opposite ends thereof, a pair of arcuate slots in the forward horizontal portion through which the vertical rods extend, the upper ends of the rods being positioned above the forward horizontal portion, and a horizontal bar connected to the upper ends of the vertical rods.

U.S. Pat. No. 3,771,811

Inventor: Adaberto Costa De Campos Bueno

Issued: Nov. 13, 1973

In toy coasters afoot driven steering rear element and a rigid elongated platform for supporting the left foot are provided both the front sections of the rigid base and pivotable rear steering element being provided with wheeled frames having means for regulating the amplitude of the angular displacement of the foot driven steering element.

U.S. Pat. No. 4,160,554

Inventor: Robert M. Cooney

Issued: Jul. 10, 1979

A skateboard accessory is disclosed comprising a rotatable platform coupled to a bearing, which bearing is in turn mounted onto a conventional skateboard. The platform is fully rotatable about an axis perpendicular to the skateboard so that the skateboard rider may twist and rotate while operating the skateboard, thereby allowing the skateboard operator to maximize his skill. The device includes a mounting apparatus for bolting the platform to skateboards without modification.

U.S. Pat. No. 4,202,559

Inventor: John Piazza, Jr.

Issued: May 13, 1980

In a skateboard comprising a rigid elongated board having front and rear portions, and front and rear wheel assemblies, the rear wheel assembly being fixedly mounted on the board rear portion, the improvement comprising a steering platform and a linkage system, secured to the front portion, connecting the platform above the board front portion and the front wheel assembly below the board front portion for pivotable movement as a unit relative to the board. Preferably the angle through which the platform/front wheel assembly unit is pivotable is limited and the platform/front wheel assembly unit is biased to a given orientation. The steering platform is spaced only slightly above the front portion and adapted to be pivoted by the forwardly disposed foot of the skateboard rider.

U.S. Pat. No. 4,230,330

Inventor: Clifton C. Muhammad

Issued: Oct. 28, 1980

A skateboard is disclosed which has a chassis, an axle and wheel assembly, and a board, with the board extending beyond one of the axles to provide an overhanging portion.

A stop pad is mounted to the underside of the skateboard in the vicinity of the overhanging portion, said stop pad generally facing the ground when the skateboard is in operational position. Therefore, by shifting weight to the overhanging portion, the rider can tilt the board, causing the stop pad to contact the ground, thereby stopping or at least slowing the skateboard. The board may be rotatably mounted to the chassis, thus allowing the rider to spin in a circle while the skateboard is following a linear course.

U.S. Pat. No. 4,445,699

Inventor: Edward Darasko

Issued: May 1, 1984

The coaster includes a wheeled foot platform, the steerable wheel of which is rotatable on a swiveled axle for effecting a steering action. The swiveled axle extends through aligned horizontal slots in vertical axle guides where are spherically curved. Each axle guide has at least one axially extending flange on which rides a bearing element or roller assembled on the axle. The roller and another bearing element assembled on the axle have complementary curved surfaces in sliding bearing engagement with opposite curved sides of each guide for axially constrained swiveled or turning movement of the axle. Steering of the coaster is obtained by a foot steerable plate mounted for pivotal movement on the foot platform. A mechanical linkage is connected at one end by a sliding pivot to the plate and at its other end to one or both ends of the swiveled axle.

U.S. Pat. No. 4,955,626

Inventor: Eric O. M. Smith

Issued: Sep. 11, 1990

This invention relates to a skateboard which includes two footboards with each footboard consisting of a foot platform and a wheel-set which carries two wheels in axial alignment fixed to the underside of the platform, a spacer element for holding the footboards in a spaced relationship and a pivot arrangement having a vertical pivot axis connecting each footboard to the spacer element to enable both footboards to pivot relatively to the spacer element.

U.S. Pat. No. 5,236,208

Inventor: Thomas Welsh

Issued: Aug. 17, 1993

A fully steerable skateboard generally comprises an elongate chassis rollingly supported by a pair of front wheels and a pair of rear wheels. Each wheel rotates about a substantially horizontal axis for rollingly supporting the chassis and rotates about a vertical axis for steering the chassis. A steering mechanism attached to the chassis and to the wheels steers the wheels in response to movement of a rider's foot. The wheels at all times define a stable support plane for said skateboard. Each said wheel is rotatable through 360 degrees. Braking is accomplished by rotating a wheel set ninety degrees to the direction of travel. According to a preferred embodiment, the wheel steering mechanism includes a pair of foot platforms for supporting a rider's feet. Steering linkage connects each foot platform to a set of wheels such that rotation of each foot platform steers the wheels. The chassis has an underside that forms a plane such that obstacles can only strike a wheel below its axle.

U.S. Pat. No. 5,458,351

Inventor: Fu B. Yu

Issued: Oct. 17, 1995

A skateboard includes a beam including two hubs disposed on the end portions. Two axles each include two wheels and each includes a shaft extended upward through the hubs. A pair of foot supports are secured on top of the shafts and rotated in concert with the shafts, and each includes two curved grooves. A stop bolt is engaged in each of the curved grooves for engaging with the beam so as to limit rotational movement of the foot supports. Another foot support is force-fittedly supported on the middle portion of the beam.

U.S. Pat. No. 6,257,614

Inventor: John C. Duggan

Issued: Jul. 10, 2001

A method of operation and sporting board foot or boot binding system that has two pivot mount plates which are able to rotate free of a sporting board, and which are connected by a rotational transmission means to cooperatively rotate both pivot mount plates in the same direction. The sporting board can be a snowboard, wakeboard, mountain board, surfboard or similar device that utilizes foot or boot mounting means of rider attachment. Braking or limiting devices can be employed to control the rotation of pivot mount plates.

French Patent Number 2760382

Inventor: Dider Fontaine

Issued: Sep. 11, 1996

The skateboard has a rectangular horizontal plate with rolling wheels and one motor wheel. This is in contact with the ground and mounted on an axle. The user stands on an upper horizontal plate. An axle, parallel to the axle of the motor wheel, is fixed to the plate and a toothed pinion is mounted on it. This has a larger diameter than a pinion that is coaxial to the wheel and they are joined together by a chain. A radial arm is fixed to the first axle and to the upper plate.

German Patent Number DE19845467

Inventor: Joel Bourdeau

Issued: Apr. 8, 1999

The holder has a fastening plate with fixing devices for attaching the plate to the board and with metal wires for holding the front and rear ends of the boot on the plate. A rear support element is connected to the fastening plate and has a curved edge for enclosing the heel and sleeve for holding the boot upper.

While these devices may be suitable for the purposes for which they were designed, they would not be as suitable for the purposes of the present invention, as hereinafter described.

In particular, U.S. Pat. No. 4,230,330 has a positive locking device and a slowing device, neither of which are conductive of free flowing motion or the ability of the rider. With this design, the rider must stop during a trick and unlock the board so that it may rotate, which is not the case with the present invention. In reference to the present invention, the operator (rider) may use the positive applied force braking system to stop the rotation, or release the force, to allow rotation during the duration of their tricks, without having to alter the mechanisms of the board.

Referring to U.S. Pat. No. 4,160,554, the design inhibits the rider's foot placement on the board for various tricks, and therefore is not as practical. Also, the bottom of the board does not allow for many of the tricks performed these days, for example, (grinding the rail). The underside of the board, or lower section, would become a hazard and an inconvenience to the rider while performing some tricks.

In conclusion, due to the fact that the present invention has no protrusions from the top surface of the top deck, or from the bottom surface of the bottom deck, it allows the rider to use the board as they would have, before the change, as well as being able to rotate the board during one or more of their tricks, without having to stop and alter the board, using it to the best of their ability.

SUMMARY OF THE PRESENT INVENTION

The present invention discloses a skateboard deck connected to a carriage by means of a rotative mechanism positioned between the deck and carriage. The carriage is comprised of a platform having the trucks and wheels mounted thereunder with fasteners fixedly positioning a bearing insert and carriage retaining ring to the top side of the platform. The deck has a friction ring fixed to the underside with fasteners passing through the deck and friction ring into the carriage retaining ring thereby enabling the deck to rotate relative to the carriage. Additionally fastened to the underside of the deck are pivot brakes or segments positioned on opposing ends of the deck and within the perimeter of the carriage platform. Once the carriage platform and deck are relatively aligned, a user shifts their weight causing the segments to engage the carriage ending or preventing any further rotation of the deck relative to the carriage.

A primary object of the present invention is to provide a skateboard having a deck that can be rotated relative to the trucks.

Another object of the present invention is to provide a wheeled article comprised of a foot mountable deck and a carriage platform with a rotative member positioned therebetween Yet another object of the present invention is to provide a wheeled article wherein the deck has a plate positioned thereunder.

Still yet another object of the present invention is to provide a wheeled article wherein the carriage is comprised of a platform having wheels and trucks fastened to the underside.

Another object of the present invention is to provide a wheeled article wherein the carriage has a bearing and retaining ring fastened to the topside of the deck.

Yet another object of the present invention is to provide a wheeled article having the deck and friction plate fastened to the carriage retaining ring thereby enabling pivotal movement of the deck, friction plate, retaining ring relative to the carriage, bearing, trucks and wheels.

Still yet another object of the present invention is to provide a wheeled article having a deck with segments fastened to the underside for engaging the carriage platform.

Additional objects of the present invention will appear as the description proceeds.

The present invention overcomes the shortcomings of the prior art by providing a skateboard deck connected to a carriage by means of a rotative mechanism positioned between the deck and carriage. The carriage is comprised of a platform having the trucks and wheels mounted thereunder with fasteners fixedly positioning a bearing and retaining ring to the top side of the platform. The deck has a friction ring fixed to the underside with fasteners passing through the deck and friction ring into the carriage retaining ring thereby enabling the deck to rotate relative to the carriage. Additionally fastened to the underside of the deck are elastomeric or polymeric segments positioned on opposing ends of the deck and within the perimeter of the carriage platform. Once the carriage platform and deck are relatively aligned, a user shifts their weight causing the segments to engage the carriage ending or preventing any further rotation of the deck relative to the carriage.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
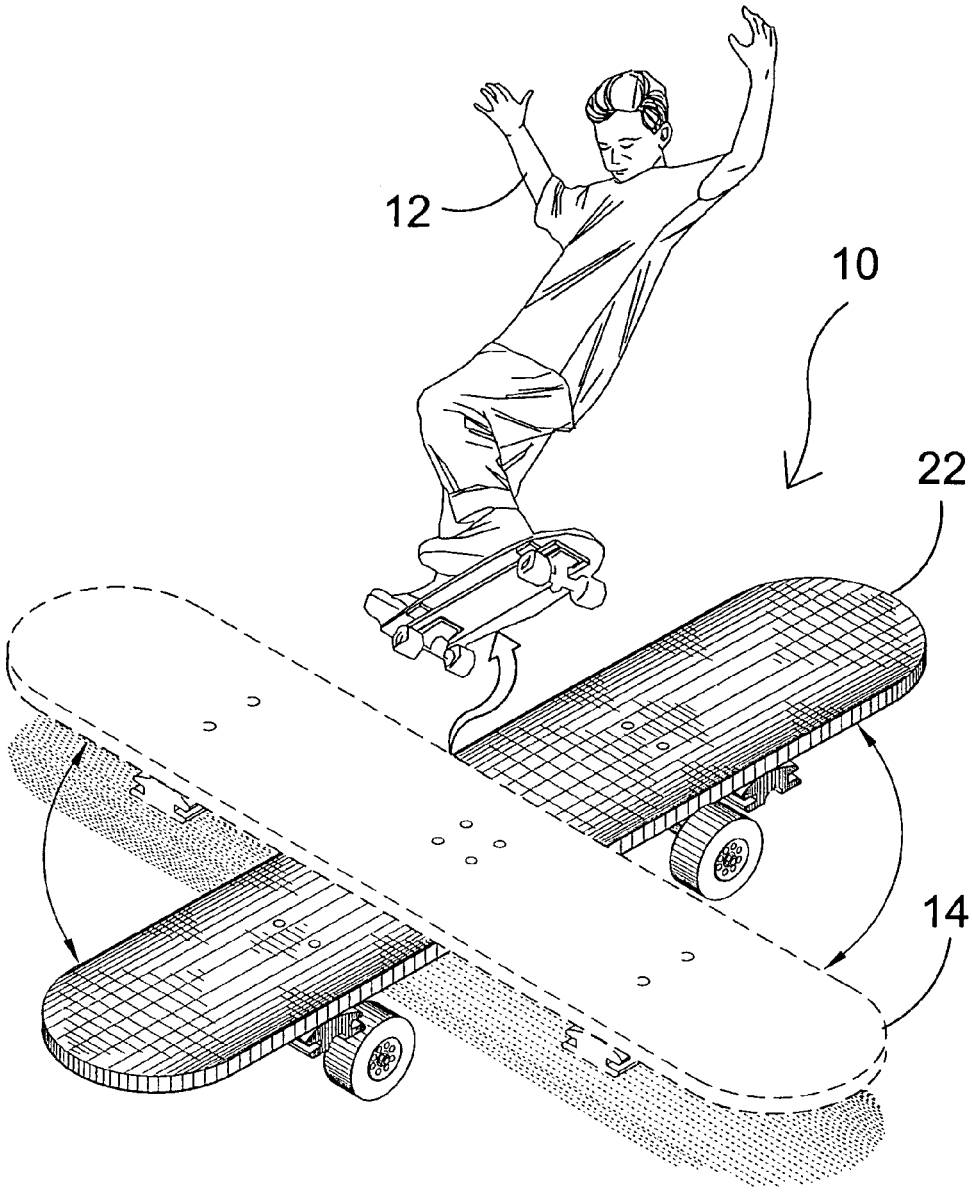
FIG. 1 is an illustrative view of the present invention in use.

With regard to reference numerals used, the following numbering is used throughout the drawings.

| | |
|---|---|
| 10 | present invention |
| 12 | user |
| 14 | skateboard deck |
| 16 | pivot brake |
| 18 | wheel |
| 20 | pivot point |
| 22 | carriage |
| 24 | pivotal member |
| 26 | assembly access hole |
| 28 | mounting hardware |
| 30 | friction ring |
| 32 | retaining ring |
| 34 | insert |
| 36 | mounting hardware |
| 38 | feet |
| 40 | engaged position |

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a skateboard upper deck 14 having a pivotal plate, located on the center of the skateboard making the skateboard deck fully rotatable about an axis perpendicular to the underlying skateboard carriage 22 allowing the skateboard operator 12 to twist and rotate while operating the skateboard. In addition, front and rear pivot brakes allow the operator 12 to stop the pivot by placing their foot to the front or rear portion of the skateboard and applying body weight to the pivot brake.

Figure 2:
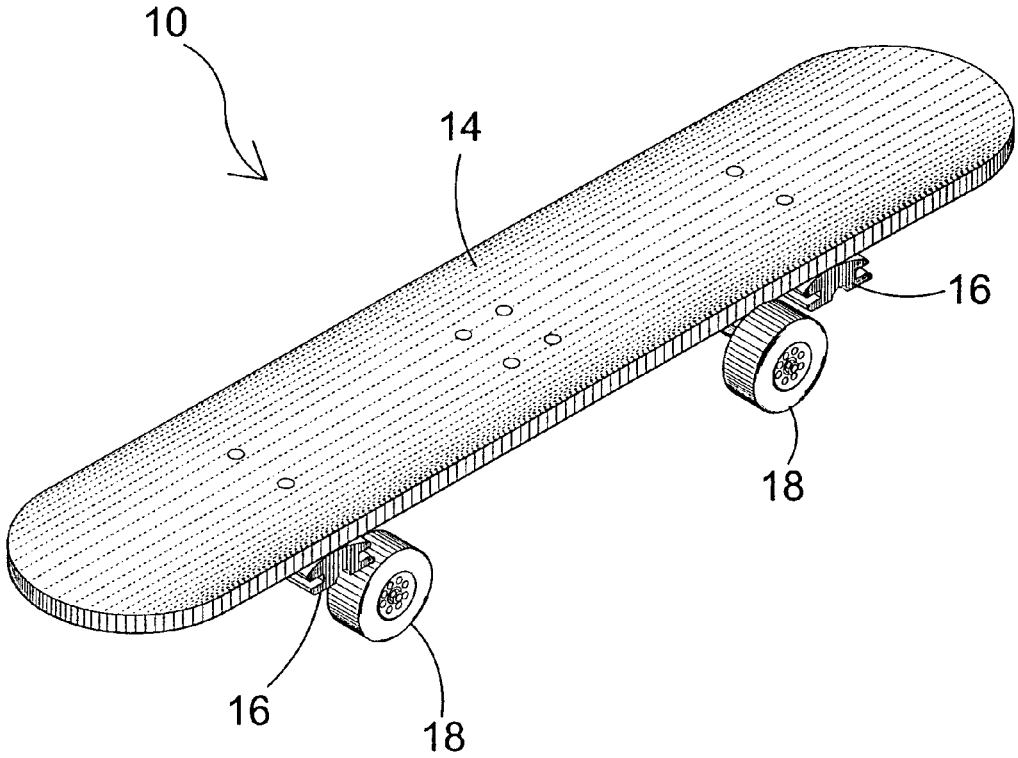
FIG. 2 is a perspective view of the present invention.

Turning to FIG. 2, shown therein is a perspective view of the present invention 10. Shown is the present invention 10 disclosing a skateboard deck 14 having a pivotal plate located on the center of the skateboard making the skateboard deck fully rotatable about an axis perpendicular to the underlying skateboard carriage (not shown) allowing the skateboard operator to twist and rotate while operating the skateboard. In addition, front and rear pivot brakes 16 allow the operator to stop the pivot by placing their foot to the front or rear portion of the skateboard 14 and applying body weight to the pivot brake 16. Front and rear wheels 18 are also shown.

Figure 3:
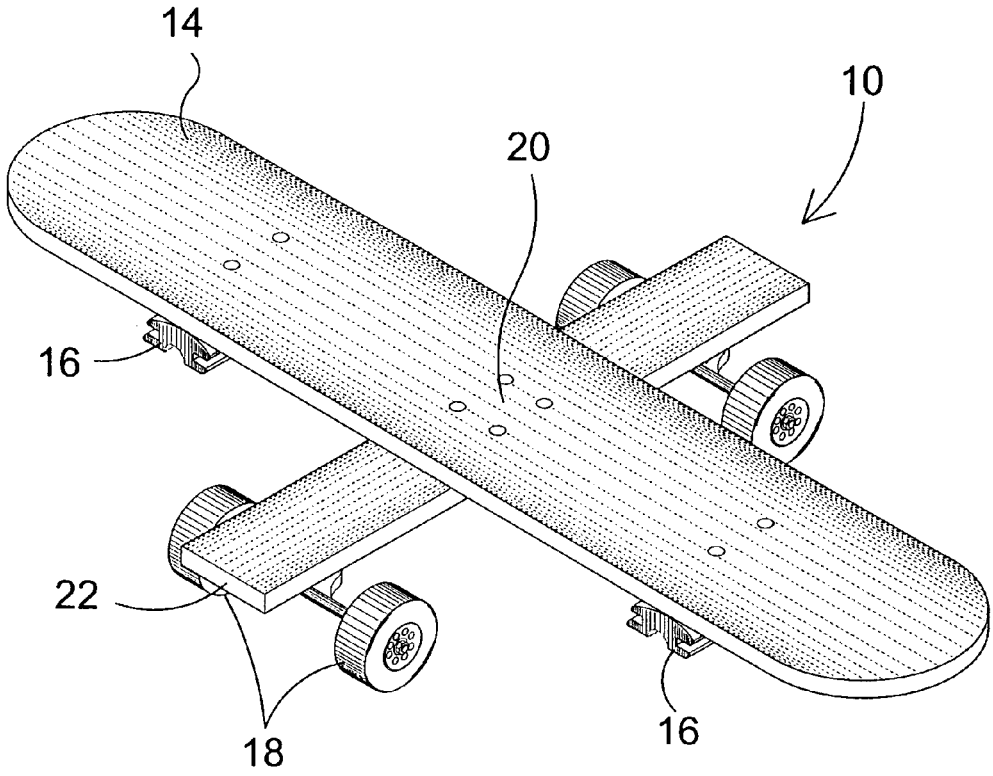
FIG. 3 is a perspective view of the present invention.

Turning to FIG. 3, shown therein is a perspective view of the present invention 10. Shown is the present invention 10 disclosing a skateboard deck 14 having a pivotal plate, located on the center or pivot point 20 of the skateboard making the skateboard deck fully rotatable about an axis perpendicular to the underlying skateboard carriage 22 allowing the skateboard operator to twist and rotate while operating the skateboard. In addition, front and rear segments or pivot brakes 16 allow the operator to stop the pivot by placing their foot to the front or rear portion of the skateboard deck 14 and applying body weight to the pivot brake 16. Also shown are wheels 18.

Figure 4:
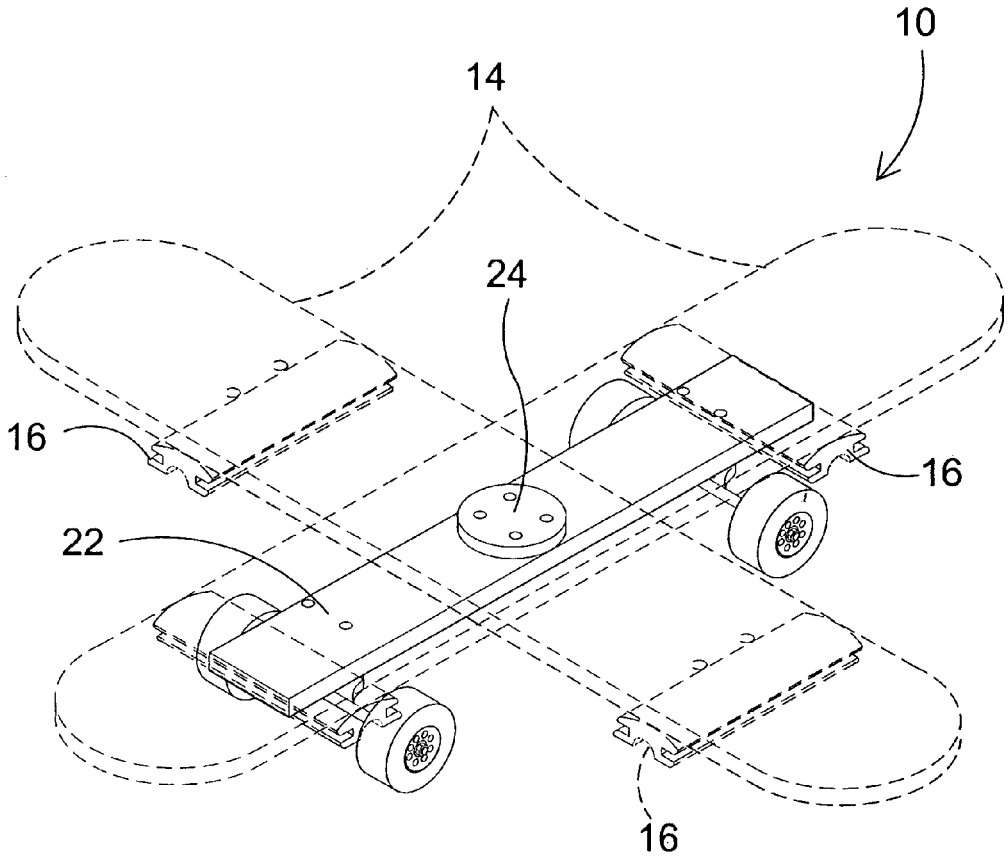
FIG. 4 is a perspective view of the present invention.

Turning to FIG. 4, shown therein is a perspective view of the present invention 10. Shown is the present invention 10 disclosing a skateboard deck 14 having a pivotal plate member 24 located on the center of the skateboard making the skateboard deck fully rotatable about an axis perpendicular to the skateboard carriage 22 allowing the skateboard operator to twist and rotate while operating the skateboard. In addition, front and rear pivot breaks 16 allow the operator to stop the pivot by placing their foot to the front or rear portion of the skateboard deck 14 and applying body weight to the pivot break 16.

Figure 5:
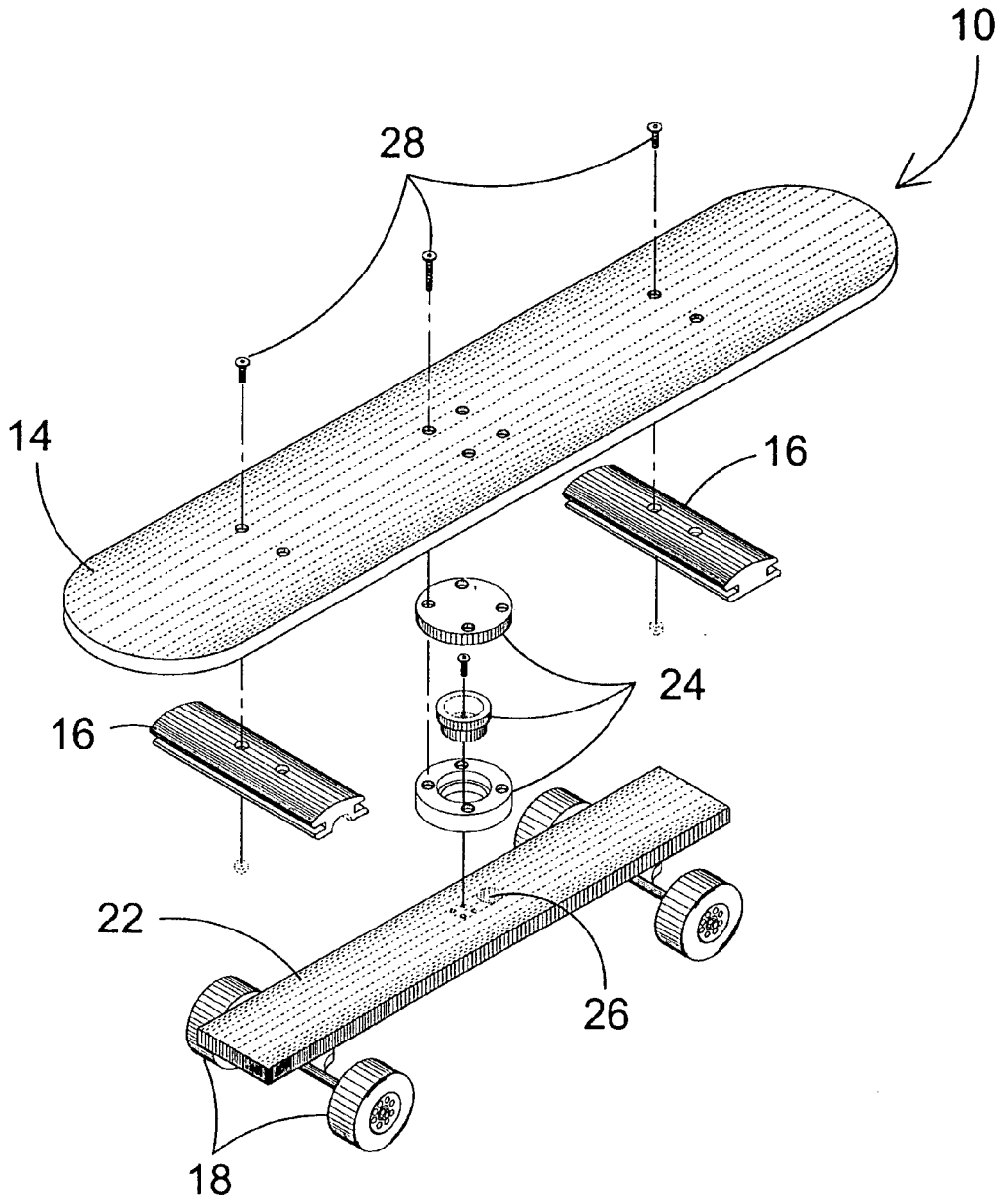
FIG. 5 is an exploded view of the present invention.

Turning to FIG. 5, shown therein is an exploded view of the present invention 10. Shown is the present invention 10 disclosing a skateboard deck 14 having a pivotal plate member 24 located underneath the center of the skateboard making the skateboard fully rotatable about an axis perpendicular to the skateboard carriage 22 allowing the skateboard operator to twist and rotate while operating the skateboard. In addition, front and rear pivot brakes 16 under the deck 14 allow the operator to stop the pivot by placing their foot to the front or rear portion of the skateboard deck 14 and applying body weight to the pivot brake 16. Also shown are wheels 18 and assembly access hole 26.

Figure 6:
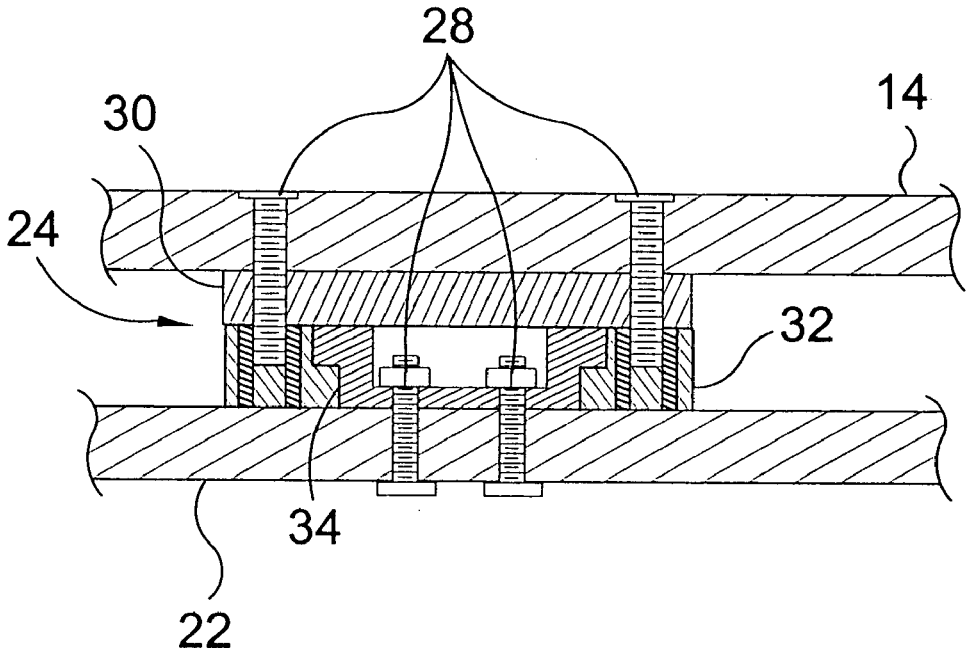
FIG. 6 is a sectional view of the pivot plate of the present invention.

Turning to FIG. 6, shown therein is a sectional view of the pivot plate of the present invention. Shown is the present invention 10 disclosing a skateboard deck 14 having a pivotal plate member 24, located on the bottom center of the skateboard making the skateboard fully rotatable about an axis perpendicular to the skateboard carriage 22 allowing the skateboard operator to twist and rotate while operating the skateboard. In addition, front and rear pivot brakes allow the operator to stop the pivot by placing their foot to the front or rear portion of the skateboard deck 14 and applying body weight to the pivot brake. Also shown are mounting hardware 28, friction ring 30, retaining ring 32 and insert 34.

Figure 7:
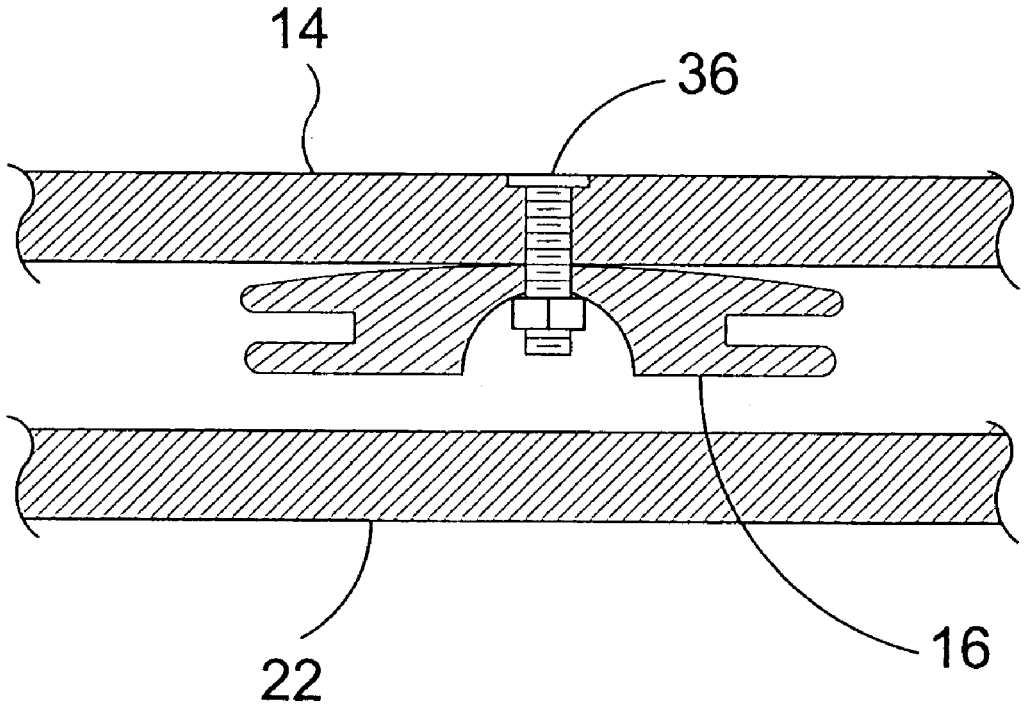
FIG. 7 is a sectional view of the pivot brake of the present invention.

Turning to FIG. 7, shown therein is a sectional view of the pivot brake of the present invention in a non-engaging position. Shown is the present invention disclosing a skateboard deck 14 having a pivotal plate, located on the center of the skateboard making the skateboard fully rotatable about an axis perpendicular to the skateboard allowing the skateboard operator to twist and rotate while operating the skateboard. In addition, front and rear pivot brakes 16 allow the operator to stop the pivot by placing their foot to the front or rear portion of the skateboard deck 14 and applying body weight to the pivot brake 16. Also shown are carriage 22 and mounting hardware 36.

Figure 8:
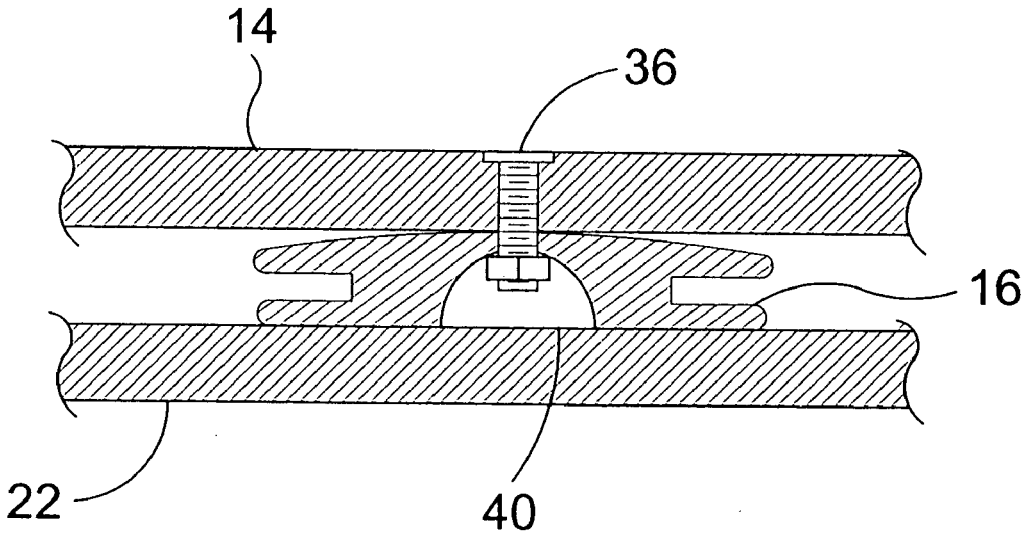
FIG. 8 is a sectional view of the pivot brake of the present invention.

Turning to FIG. 8, shown therein is a sectional view of the pivot brake of the present invention in an engaged position at 40. Shown is the present invention disclosing a skateboard deck 14 having a pivotal plate located on the center of the skateboard making the skateboard fully rotatable about an axis perpendicular to the skateboard carriage 22 allowing the skateboard operator to twist and rotate while operating the skateboard. In addition, front and rear pivot brakes 16 with mounting hardware 36 allow the operator to stop the pivot by placing their foot to the front or rear portion of the skateboard 14 and applying body weight to the pivot brake 16 to cause engagement at 40.

Figure 9:
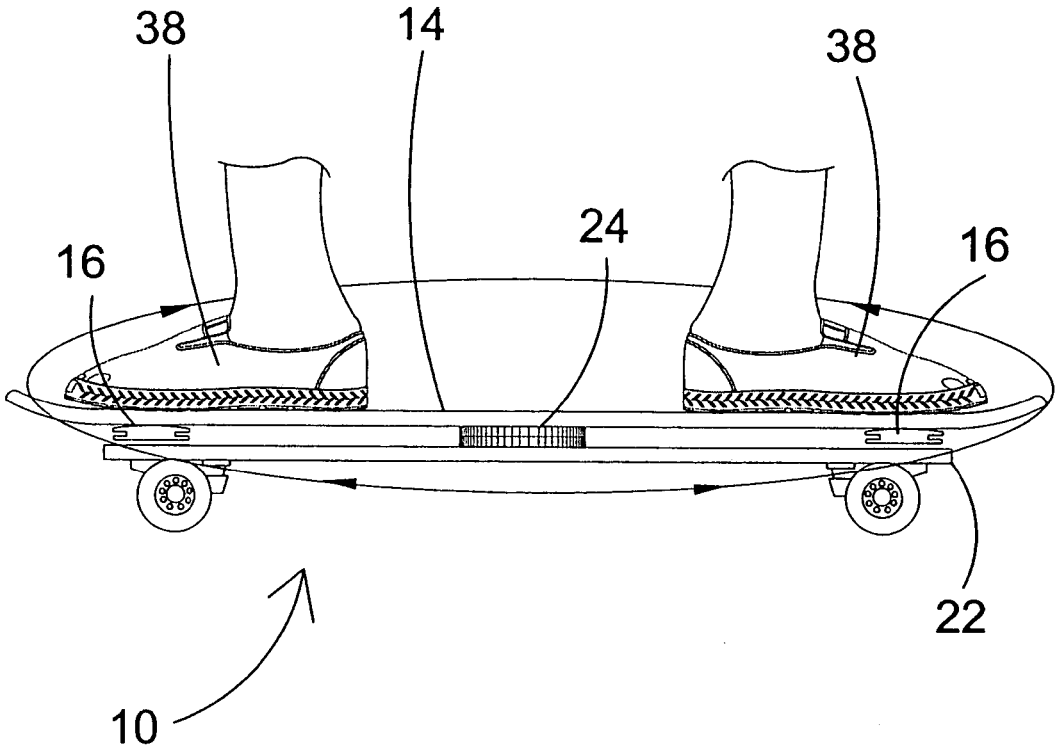
FIG. 9 is an illustrative view of the pivot member of the present invention in use.

Turning to FIG. 9, shown therein is an illustrative view of the pivot member of the present invention 10 in use. Shown is the present invention 10 disclosing a skateboard deck 14 having a pivotal plate member 24 located on the center of the skateboard making the skateboard fully rotatable about an axis perpendicular to the skateboard carriage 22 allowing the skateboard operator to twist and rotate while operating the skateboard. In addition, front and rear pivot brakes 16 allow the operator to stop the pivot by placing their foot 38 to the front or rear portion of the skateboard deck 14 and applying body weight to the pivot brake 16. When the feet 38 are placed at the center or evenly distributed between the front and rear of the skateboard deck 14 the pivot brake 16 is not engaged as shown in FIG. 9 and the skateboard deck 14 is free to rotate in either direction.

Figure 10:
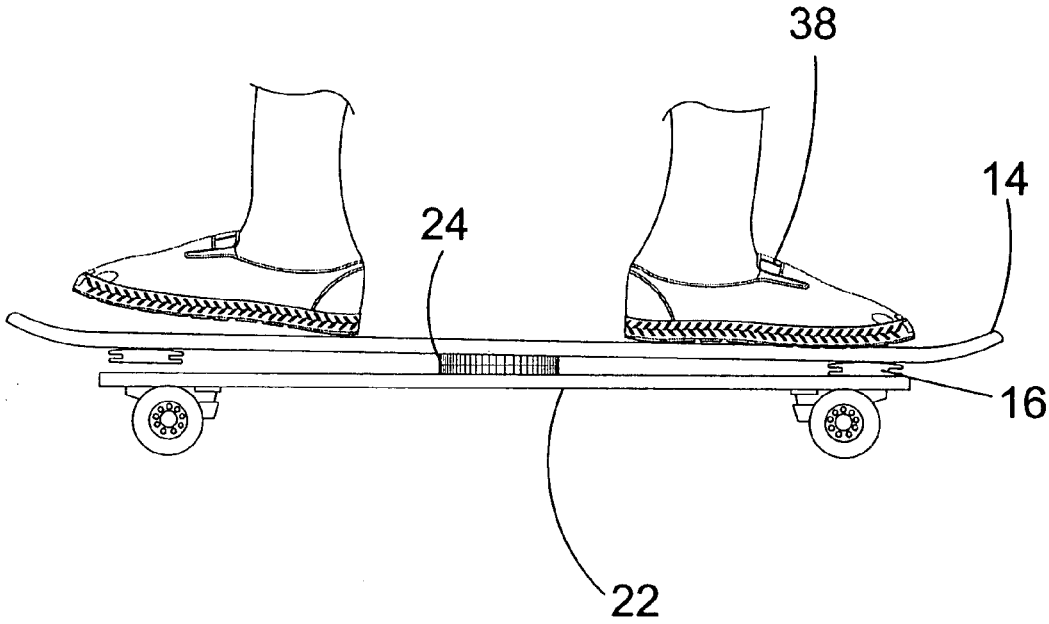
FIG. 10 is an illustrative view of the front pivot brake of the present invention in use.

Turning to FIG. 10, shown therein is an illustrative view of the front pivot brake of the present invention 10 in use. Shown is the present invention 10 disclosing a skateboard deck 14 having a pivotal plate member 24 located on the center of the skateboard making the skateboard fully rotatable about an axis perpendicular to the skateboard carriage 22 allowing the skateboard operator to twist and rotate while operating the skateboard. In addition, front and rear pivot brakes 16 allow the operator to stop the pivot by placing their foot 38 to the front or rear portion of the skateboard deck 14 and applying body weight to the pivot brake 16. When foot 38 is placed on front pivot brake 16 it becomes engaged and rotation is prevented.

Figure 11:
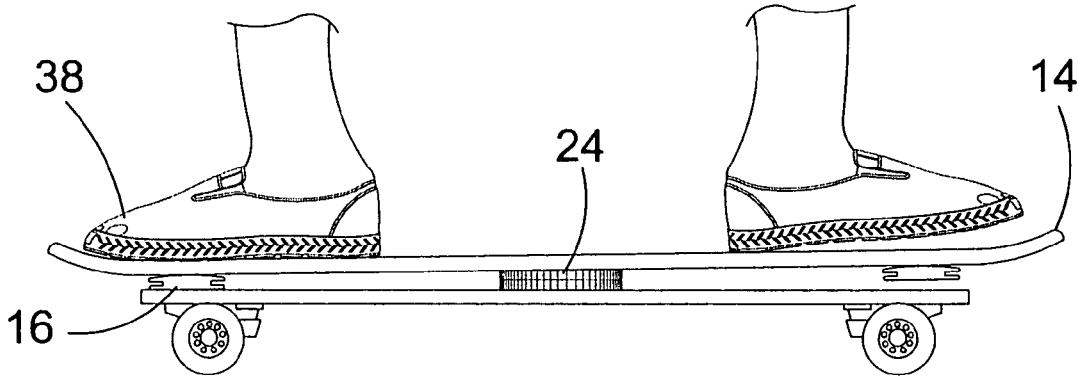
FIG. 11 an illustrative view of the front pivot brake of the present invention in use.

Turning to FIG. 11, shown therein is an illustrative view of the rear pivot brake of the present invention in use. Shown is the present invention 10 disclosing a skateboard deck 14 having a pivotal plate member 24 located on the center of the skateboard making the skateboard fully rotatable about an axis perpendicular to the skateboard carriage 22 allowing the skateboard operator to twist and rotate while operating the skateboard. In addition, front and rear pivot brakes 16 allow the operator to stop the pivot by placing their foot 38 to the front or rear portion of the skateboard deck 14 and applying body weight to the pivot brake 16. When body weight through foot 38 is shifted to the rear, the rear pivot brake 16 engages to prevent rotation.

I claim:

1. An apparatus for a rotating skateboard, comprising:

a) a skateboard deck having first and second side edges, first and second ends and an upper and lower surface to permit a user to stand on the upper surface of the skateboard deck;

b) a carriage for said skateboard deck, said carriage having first and second ends and an upper and lower surface to permit the carriage to support the skateboard deck;

c) a plurality of ground engaging wheels being disposed on said lower surface of said carriage to permit the apparatus to roll about on the ground;

d) wherein said skateboard deck is rotatable mounted to said carriage so that said skateboard deck rotates horizontally about an axis perpendicular to said carriage; and e) a pivot brake being disposed on said lower surface of said first and second ends of said skateboard deck, wherein said pivot brake is disposed above said upper surface of said carriage, so that by putting weight on either said first or second ends of said skateboard deck a rider can tilt said skateboard deck and cause one of said first and second pivot brakes to contact said upper surface of said carriage to prevent rotation of said skateboard deck about said carriage.

2. The apparatus of claim 1, wherein said pivot brake is a segment of material being about the same size as the width of said skateboard deck from said first to second side edges.

3. The apparatus of claim 2, wherein said skateboard deck is rotatably mounted to said carriage by a pivotal member disposed between said skateboard deck and said carriage.

4. The apparatus of claim 3, wherein said pivotal member comprises a retaining ring having a bearing insert therein, said bearing insert being connected to said upper surface of said carriage so that said bearing insert is rotatable in said retaining ring.

5. The apparatus of claim 4, wherein said pivotal member comprises a friction ring being connected to said lower surface of said skateboard deck, wherein said friction ring is fixedly connected to said retaining ring so that said skateboard deck can rotate relative to said carriage.

6. The apparatus of claim 5, wherein said bearing insert is connected to said upper surface of said carriage using a plurality of fasteners.

7. The apparatus of claim 6, wherein said friction ring is connected to said skateboard deck and said retaining ring using a plurality of fasteners.

8. The apparatus of claim 7, wherein the distance between said first and second ends of said carriage is greater than the distance between said first and second pivot brakes.

9. The apparatus of claim 8, wherein the distance between said first and second ends of said skateboard deck is greater than the distance between said first and second ends of said carriage.

10. An apparatus for a rotating skateboard, comprising:

a) a skateboard deck having first and second side edges first and second ends and an upper and lower surface to permit a user to stand on the upper surface of the skateboard deck;

b) a carriage for said skateboard deck said carriage having first and second ends and an upper and lower surface to permit the carriage to support the skateboard deck;

c) a plurality of ground engaging wheels being disposed on said lower surface of said carriage to permit the apparatus to roll about on the ground;

d) wherein said skateboard deck is rotatable mounted to said carriage so that said skateboard deck rotates horizontally about an axis perpendicular to said carriage; and means for a pivot brake whereby the relative rotation between the skateboard deck and the carriage can be stopped by a rider shifting his weight toward the first or second ends of the skateboard deck.

11. The apparatus of claim 10, wherein said skateboard deck is rotatably mounted to said carriage by a pivotal member disposed between said skateboard deck and said carriage.

12. The apparatus of claim 11, wherein said pivotal member comprises a retaining ring having a bearing insert therein, said bearing insert being connected to said upper surface of said carriage so that said bearing insert is rotatable in said retaining ring.

13. The apparatus of claim 12, wherein said pivotal member comprises a friction ring being connected to said lower surface of said skateboard deck, wherein said friction ring is fixedly connected to said retaining ring so that said skateboard deck can rotate relative to said carriage.

14. The apparatus of claim 13, wherein said bearing insert is connected to said upper surface of said carriage using a plurality of fasteners.

15. The apparatus of claim 14, wherein said friction ring is connected to said skateboard deck and said retaining ring using a plurality of fasteners.

16. The apparatus of claim 15, wherein the distance between said first and second ends of said carriage is greater than the distance between said first and second pivot brakes.

17. The apparatus of claim 16, wherein the distance between said first and second ends of said skateboard deck is greater than the distance between said first and second ends of said carriage.

* * * * *